US008231417B2

(12) United States Patent
Zhu

(10) Patent No.: US 8,231,417 B2
(45) Date of Patent: Jul. 31, 2012

(54) ELECTRICAL CONNECTOR HAVING CONTACTS WITH MULTIPLE SOLDERING PORTIONS

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/035,673

(22) Filed: Feb. 25, 2011

(65) Prior Publication Data

US 2011/0287641 A1 Nov. 24, 2011

(30) Foreign Application Priority Data

May 21, 2010 (CN) ..... 2010 2 0198872 U

(51) Int. Cl.
*H01R 4/48* (2006.01)

(52) U.S. Cl. ..... 439/862

(58) Field of Classification Search ..... 439/862, 439/500

See application file for complete search history.

(56) References Cited

U.S. PATENT DOCUMENTS

| | | | | |
|---|---|---|---|---|
| 5,259,768 | A * | 11/1993 | Brunker et al. | 439/60 |
| 5,338,230 | A | 8/1994 | Bryce et al. | |
| 7,029,287 | B2 | 4/2006 | Matsunaga et al. | |
| 7,803,011 | B1 * | 9/2010 | Mai | 439/500 |
| 7,806,739 | B2 | 10/2010 | Hu et al. | |

* cited by examiner

*Primary Examiner* — Phuong Dinh

(74) *Attorney, Agent, or Firm* — Wei Te Chung; Andrew C. Cheng; Ming Chieh Chang

(57) ABSTRACT

An electrical connector includes an insulative housing and a plurality of contacts is received in the housing. The insulative housing defines a mounting face, a mating face perpendicular to the mounting face and a number of passageways opening to both the mounting face and the mating face. Each contact includes a contacting portion located in front of the mating face of the insulative housing, and a first soldering portion and a second soldering portion adjacent to the mounting face. The second soldering portion is closer to the mating face relative to the first soldering portion.

10 Claims, 4 Drawing Sheets

ELECTRICAL CONNECTOR HAVING CONTACTS WITH MULTIPLE SOLDERING PORTIONS

BACKGROUND OF THE INVENTION

1. Field of the Invention

The present invention generally relates to an electrical connector having contacts with multiple soldering portions.

2. Description of Related Art

Board mounting strength and stability of electrical connection are important factors for board-end connector and particularly to board-end battery connectors which are used to bear changeable external force frequently.

U.S. Pat. No. 7,806,739 issued to Hu et al. on Oct. 5, 2010 discloses a battery connector including an insulative housing and a plurality of contacts received in the housing. The insulative housing defines an assembling face attaching to a printed circuit board and a mating face coupling with a battery. The insulative housing defines a plurality of passageways extending through the assembling face and the mating face for receiving the contacts. The contact is equipped with a soldering part, a retaining part which consecutively connects with the soldering part and is retained in the insulative housing, a contacting part, and an elastically deformed part between the retaining part and the contacting part. When the battery is assembled to the battery connector, the battery meets with the contacting parts of the contacts first, and presses against the contacting parts to deform the deformed parts when the battery is pushed deeper. The deformed parts have elasticity and keep the battery in a right position responding to the elasticity. However, the soldering part of each contact may be deformed along the press direction such that the connecting stability is decreased.

Hence, an improved electrical connector is desired to overcome the disadvantages of the prior art.

BRIEF SUMMARY OF THE INVENTION

An object of the invention is to provide an electrical connector with multiple soldering portion, thereby increasing connecting stability and mounting strength.

To achieve the above object, an electrical connector includes an insulative housing and a plurality of contacts is received in the housing. The insulative housing defines a mounting face, a mating face perpendicular to the mounting face and a number of passageways opening to both the mounting face and the mating face. Each contact includes a contacting portion located in front of the mating face of the insulative housing, and a first soldering portion and a second soldering portion adjacent to the mounting face. The second soldering portion is closer to the mating face relative to the first soldering portion.

Other objects, advantages and novel features of the invention will become more apparent from the following detailed description of the present embodiment when taken in conjunction with the accompanying drawings.

DETAILED DESCRIPTION OF THE INVENTION

Figure 1:
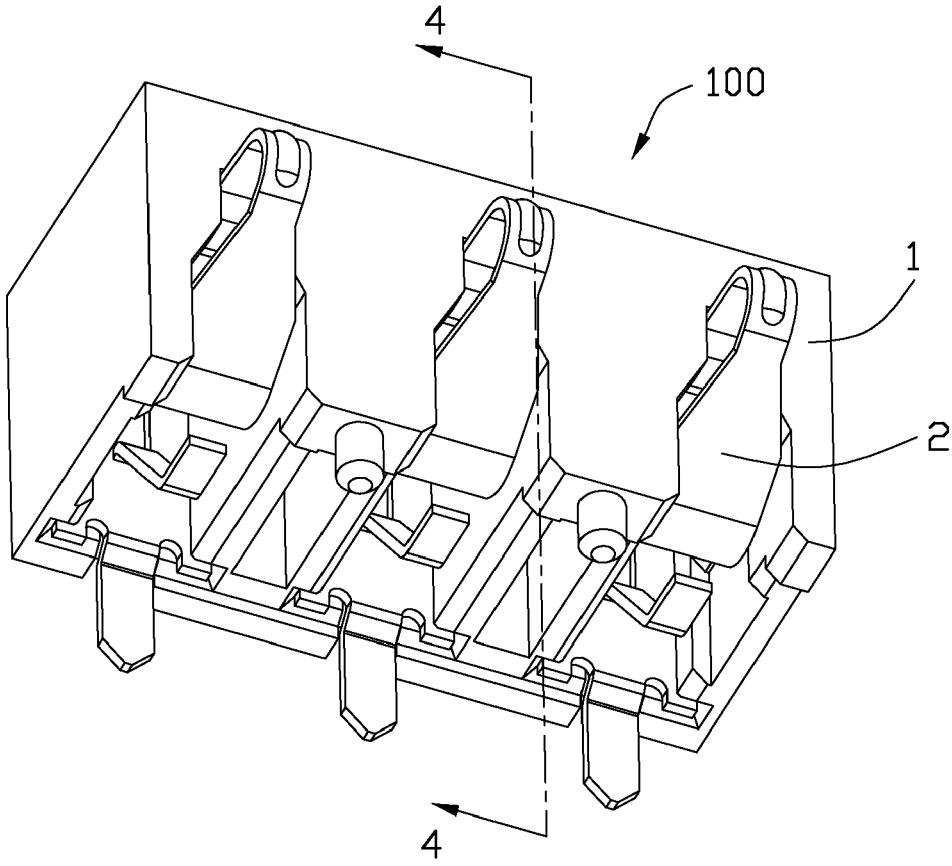
FIG. 1 is a perspective view of an electrical connector of an embodiment of the present invention.

Reference will now be made to the drawing figures to describe the present invention in detail.

Figure 2:
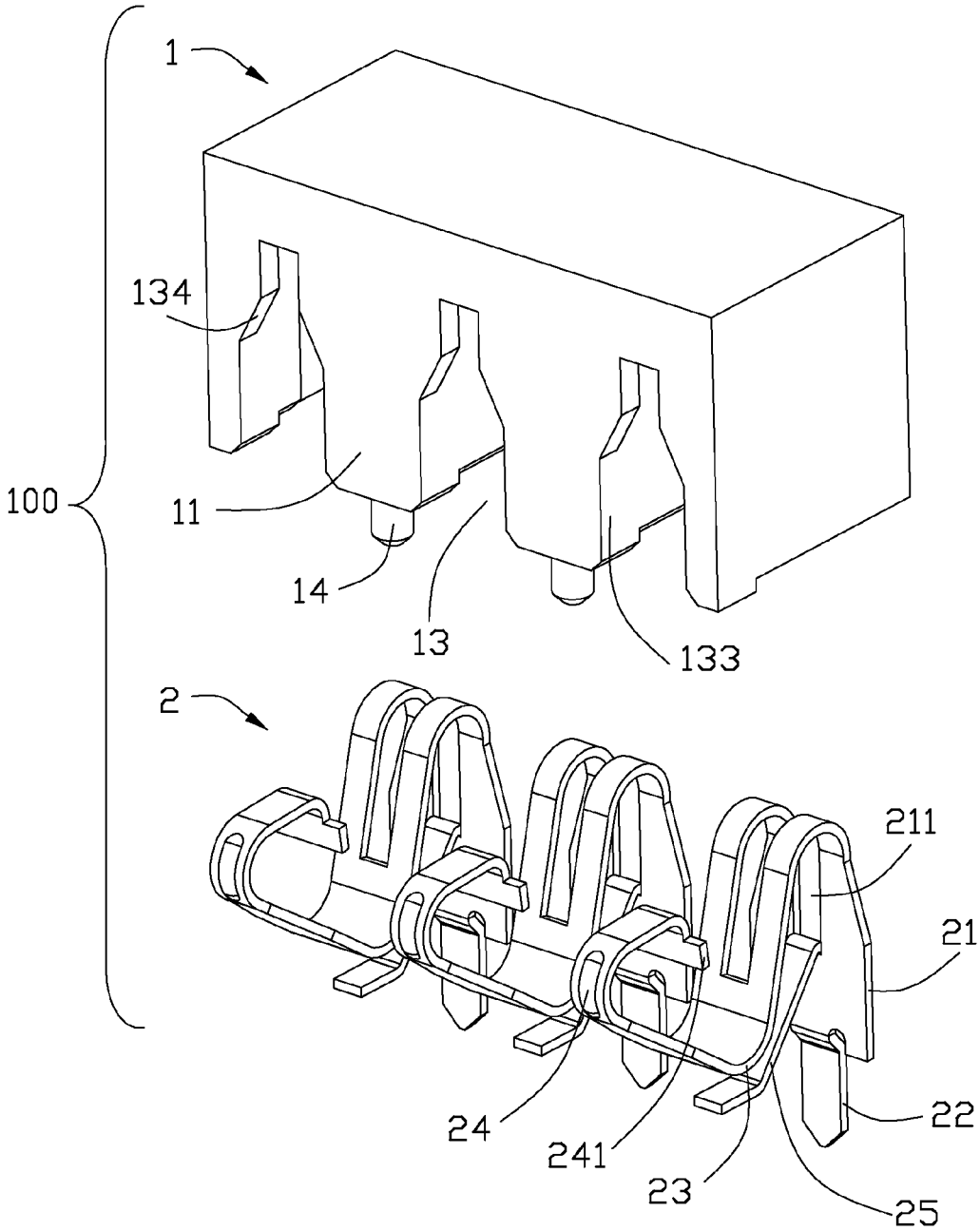
FIG. 2 is an exploded, perspective view of the electrical connector of FIG. 1.
Figure 3:
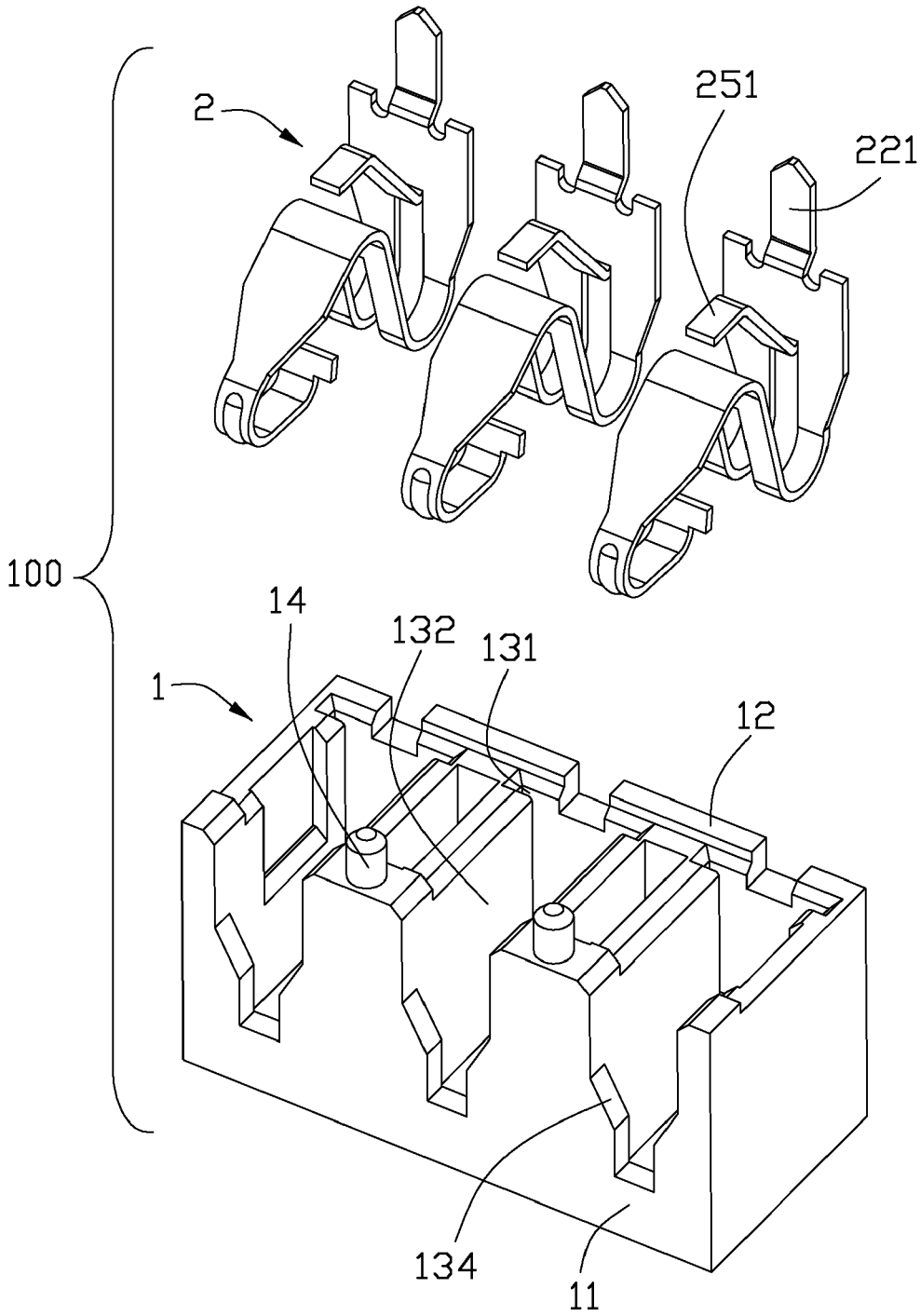
FIG. 3 is another exploded, perspective view of the electrical connector of FIG. 1.
Figure 4:
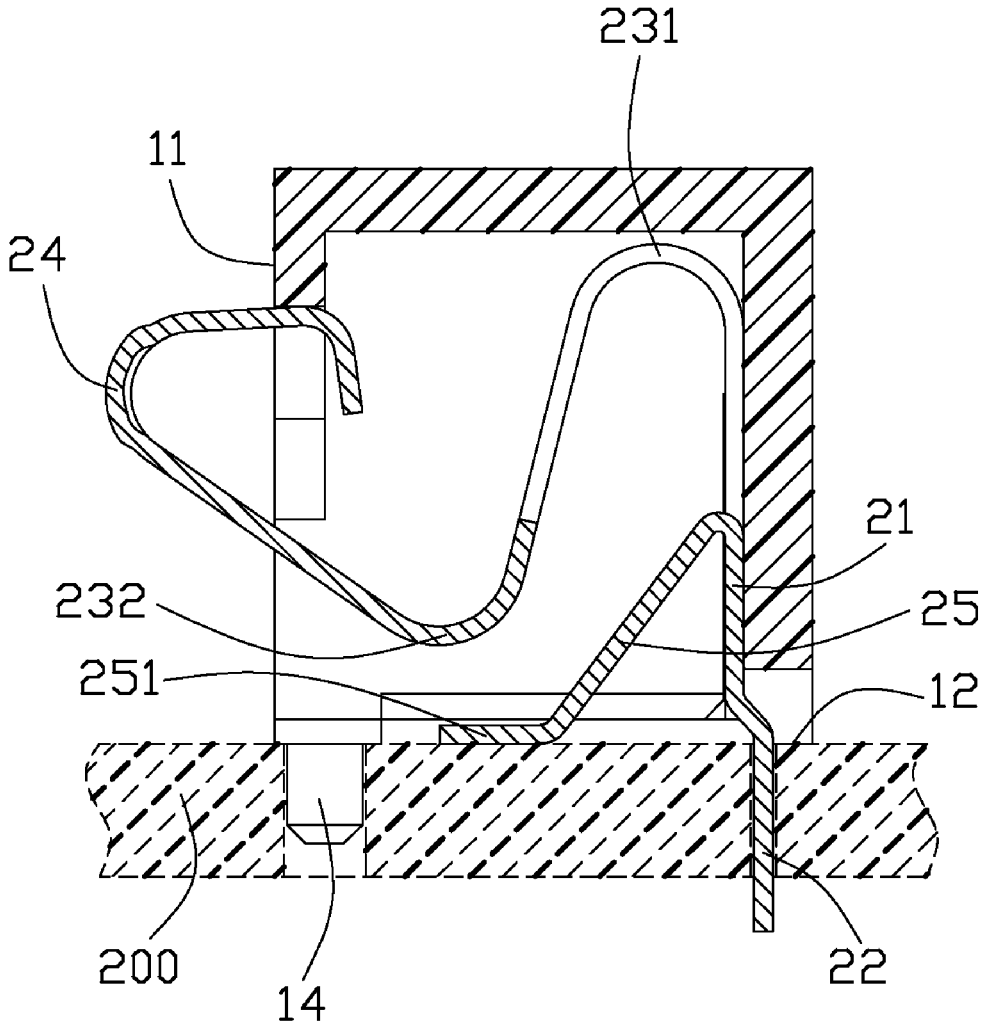
FIG. 4 is a cross sectional view along a line 4-4 in FIG. 1.

Referring to FIGS. 1-4, a battery connector 100 of the present invention, used for connecting with a battery (not shown) and a printed circuit board 20 (PCB) shown in the dashed line in FIG. 4), includes an insulative housing 1, a plurality of contacts 2 received in the insulative housing 10.

Referring to FIGS. 2-3, the insulative housing 1 is rectangular and has a mating face 11 coupling with the battery, a rear face (not labeled) opposite to the mating face 11, a mounting face 12 perpendicular to the mating face 11 for attaching to the PCB and three contact passageways 13 opening to both of the mating face 11 and the mounting face 12. Each passageway 13 comprises a retaining slot 131 vertically hollowed from the mounting face 12 near to the rear face and a receiving slot 132 with a mating opening 133 formed on the mating face 11. Each mating opening 133 further forms a pair of stop walls 134 located far away from the mounting face 12. Each of the two mounting posts 14 downwardly extends between the corresponding two passageways 13 around the mating openings 133.

Referring to FIGS. 2-4, each contact 2 is made from a metal sheet and comprises a retaining portion 21, a first soldering or mounting end 22 extending from a bottom free end of the retaining portion 21 and going through the PCB, a contacting end 24 protruding out of the mating opening 133 and an elastically deformed part 23 between the deformed part 23 and contacting end 24. Each deformed part 23 has an approximately "S" shape, comprising a first bending section 231 extending away from the mounting face 12 and a second bending section 232 extending towards the mounting face 12. The contacting end 24 further forms a bending end (not labeled) towards the rear face and a pair of shoulders 241 on the bending. After the contact 2 is assembled to the insulative housing 1 from the mounting face 12, the retaining portion 21 is engaged in the retaining slot 131 and the shoulders 241 are pressed against the inner side of the stop walls 134 such that the contacting end 24 can be limited in the receiving slot 132 to optimize the mating performance.

A branched strip 25 is stamped on the retaining portion 21 along the length direction of each contact 2, forming a fixed end on the first soldering end 22 and a free end on the first bending section 231. The free end of the branched strip is bending towards the mating face 11 and towards the mounting face 12 as a flat second soldering or mounting end 251, leaving a longitudinal through hole 211 on the contact 2. The angle between the branched strip 25 and the retaining portion 21 is less than 90 degrees in order to make a strength triangle structure. The second soldering ends 251 are parallel to the mounting face 12 which are adapted for SMT and the first soldering ends 22 are perpendicular to the mounting face which are adapted for through hole soldering. Meanwhile, this double soldering ends design can also ensure the connecting stability. It is also noted that the first soldering end 22 and the second soldering end 251 are essentially aligned with each other in a front-to-back direction while are offset from the adjacent mounting post 14 in both the front-to-back direction and the transverse direction perpendicular to said front-to-back direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a mounting face, a mating face perpendicular to the mounting face and a number of passageways opening to both the mounting face and the mating face;

a plurality of contacts received in the passageways, each contact comprising a contacting portion located in front of the mating face of the insulative housing, and a first soldering portion and a second soldering portion adjacent to the mounting face the second soldering portion being closer to the mating face relative to the first soldering portion, the mating face is at an outwardly facing side of the housing, wherein each contact comprises a retaining portion retained in the insulative housing, the first soldering portion extend from an end of the retaining portion adjacent to the mounting portion and the second soldering portion slant to the mounting face from the retaining portion adjacent to an opposite end to said end of the retaining portion, the first soldering portion is perpendicular to the mounting face and the second soldering portion has a distal end parallel to the mounting face, wherein the slant angle between the second soldering portion and the retaining portion is less than 90 degrees to form a triangle structure, wherein each second soldering portion is stamped and branched out from interior of the main body of the contact, leaving a elongate hollow.

2. The electrical connector as claimed in claim 1, wherein the first soldering portion and the second soldering portion are essentially aligned with each other in a mating direction.

3. The electrical connector as claimed in claim 2, wherein said housing is further equipped with a mounting post closer to the mating face than both said first soldering portion and said second soldering portion while is not aligned with said first soldering portion and said second soldering portion in said mating direction.

4. The electrical connector as claimed in claim 3, wherein each of said passageways is dimensioned and configured to allow the corresponding contact to be inserted thereinto from the mounting face and have the contacting portion extending beyond the mating face, the first soldering portion extending beyond the mounting face while keeping the second soldering portion essentially coplanar with the mounting face.

5. The electrical connector as claimed in claim 2, wherein each of the contacts further includes a retaining portion retained in the housing, from which the first soldering portion rearwardly and downwardly extends away from the mating face while the second soldering portion forwardly and downwardly extends toward the mating face.

6. An electrical contact, comprising:

a vertical retaining portion with barbs at lateral sides thereof;

an elastically deformed portion extending from a top end of the retaining portion with a contacting portion at a distal free end thereof facing perpendicular to the retaining part;

a first soldering portion extending from a bottom end of the retaining portion;

a second soldering portion slant from the retaining portion with a sharp angle to the first soldering portion and near to the contacting portion relative to the first soldering portion, the mating face is at an outwardly facing side of the housing, the first soldering portion is perpendicular to the mounting face and the second soldering portion has a distal end parallel to the mounting face, wherein each second soldering portion is stamped and branched out from interior of the main body of the contact, leaving an elongate hollow.

7. An electrical connector for mounting to a printed circuit board and mating with a complementary connector, comprising:

an insulative housing defining a plurality of passageways forwardly and downwardly communicating with an exterior via corresponding mating and mounting faces which are perpendicular to each other essentially wherein the mounting face is adapted for confronting the printed circuit board while the mating face is adapted for confronting the complementary connector;

a plurality of contacts upwardly inserted into the corresponding passageways, respectively, via the mounting face, each of said contacts defining unitarily a contacting portion extending forwardly beyond the mating face, a first mounting portion downwardly extending beyond the mounting face, and a second mounting portion with a horizontally extending end essentially coplanar with the mounting face, the mating face is at an outwardly facing side of the housing, wherein the housing is further equipped with at least one mounting post downwardly extending beyond the mounting face around the mating face, wherein the first mounting portion is located at a rear side of the housing farther from the mating face in a front-to-back direction, wherein the first mounting portion and the second mounting portion are aligned with each other in a front-to-back direction, wherein the housing is further equipped with at least one mounting post downwardly extending beyond the mounting face around the mating face under condition that the first mounting portion and the second mounting portion are aligned with each other in a front-to-back direction while the mounting post is not aligned with the first mounting portion and the second mounting portion in the front-to-back direction.

8. The electrical connector as claimed in claim 7, wherein said first mounting portion, the end of the second mounting portion and the mounting post are arranged as in a triangle in a top view.

9. The electrical connector as claimed in claim 7, wherein each of the contacts further defines a vertical retaining portion abutting against a rear wall of the housing from which both said first mounting portion and said second mounting portion extend, under condition that the first mounting portion is not coplanar with the retaining portion but rearwardly offset therefrom and essentially located right under the rear wall in the vertical direction.

10. The electrical connector as claimed in claim 7, wherein both said first mounting portion and said second mounting portion are used to be soldered unto the printed circuit board.

* * * * *